United States Patent [19]

Farina et al.

[11] Patent Number: 4,939,345

[45] Date of Patent: Jul. 3, 1990

[54] PORTABLE HAIR DRYER ASSEMBLY

[76] Inventors: Michelle J. Farina; Jo-Ann Frontario, both of 40-38 - 220th St., Bayside, N.Y. 11361

[21] Appl. No.: 326,737

[22] Filed: Mar. 21, 1989

[51] Int. Cl.[5] ..... F24H 3/04

[52] U.S. Cl. ..... 219/370; 34/97

[58] Field of Search ..... 320/2; 219/240, 242, 219/370, 368, 373, 364; 34/96-101

[56] References Cited

U.S. PATENT DOCUMENTS

| | | | |
|---|---|---|---|
| 2,432,067 | 12/1947 | Morse | 219/364 |
| 3,377,715 | 4/1968 | Hubner | 219/240 |
| 3,797,475 | 3/1974 | Hughes | 219/370 |
| 3,964,708 | 6/1976 | Reeves | 219/242 |
| 4,097,722 | 6/1978 | Soler et al. | 34/97 |
| 4,227,541 | 10/1980 | Satchell | 219/240 |
| 4,232,454 | 11/1980 | Springer | 34/97 |
| 4,757,183 | 7/1988 | Karey et al. | 219/365 |

FOREIGN PATENT DOCUMENTS

| | | | |
|---|---|---|---|
| 156756 | 12/1979 | Japan | 219/373 |
| 2032271 | 5/1980 | United Kingdom | 219/242 |
| 2170705 | 8/1986 | United Kingdom | 34/96 |

*Primary Examiner*—Philip H. Leung
*Assistant Examiner*—Geoffrey S. Evans
*Attorney, Agent, or Firm*—Terry M. Gernstein

[57] ABSTRACT

A portable hair dryer assembly includes a battery that is recharged to operate the air moving system of the assembly. The assembly further includes a cover for the air intake system, and a system for moving the air exhaust nozzle so that the assembly has a plurality of degrees of freedom.

1 Claim, 2 Drawing Sheets

PORTABLE HAIR DRYER ASSEMBLY

TECHNICAL FIELD OF THE INVENTION

The present invention relates to the general art of hair dryers, and to the particular field of portable hair dryers.

BACKGROUND OF THE INVENTION

A hair dryer usually includes a means for moving warm air at a high volumetric flow rate towards a prescribed area. Thus, most proposed designs for hair dryers include a motor-driven fan that is powered by utility power via a plug-in cord.

However, due to increased mobility, many people require a portable hair dryer for use in traveling or the like. Therefore, there have been several designs for so-called portable hair dryers for use in traveling. However, such hair dryers, while characterized as being "portable" still require a source of utility power to operate the motor-driven fan. Thus, in such cases, "portable" only means "small". True portability requires the hair dryer to include an independent source of power.

Therefore, there is a need for a portable hair dryer assembly that can operated independent of and without the need of utility power.

A still further drawback of many hair dryers is their susceptibility to clogging due to hair jamming the motor. Many otherwise good hair dryers have been discarded because the motor is malfunctioning, and such motor malfunctioning is simply caused by loose hair picked up by the motor intake system while the dryer assembly is being used. The small "portable" hair dryers are more susceptible to such jamming since the motor units of these hair dryers are small and often difficult to reach so they cannot be efficiently and economically cleaned even if the problem is recognized.

A still further problem with portable hair dryers is caused by their compactness. To be compact, the air exhaust opening is often small, thereby requiring the entire hair dryer assembly to be moved continuously during a drying operation. Such movement further exposes the dryer to picking up loose hair.

Accordingly, there is a need for a portable hair dryer which is not susceptible to having loose hair clog the motor unit and which can be efficiently operated with a minimum amount of movement of the overall assembly.

OBJECTS OF THE INVENTION

It is a main object of the present invention to provide a hair dryer that is truly portable.

It is another object of the present invention to provide a portable hair dryer that can be operated without utility power.

It is another object of the present invention to provide a portable hair dryer that is efficient to use.

It is another object of the present invention to provide a portable hair dryer that is not susceptible to loose hair clogging the motor unit thereof.

SUMMARY OF THE INVENTION

These, and other, objects are achieved by providing a small hand-holdable hair dryer apparatus that includes a battery driven fan-motor unit which is driven from a re-chargeable battery. The apparatus also includes a battery recharging system.

The apparatus further includes a fine mesh screen on the air intake system for preventing loose hair from entering the motor unit, and has an exhaust system that is movable using a knob on the handle of the apparatus.

In this manner, the hair dryer assembly can be operated without a continuous connection to a source of utility power, and the air from the assembly can be moved in several degrees of freedom in an easy manner. Still further, the assembly is more reliable than presently available hair dryers since it is not as susceptible to clogging by loose hair as are the presently available hair dryers.

DETAILED DESCRIPTION OF THE PREFERRED EMBODIMENT OF THE INVENTION

Figure 1:
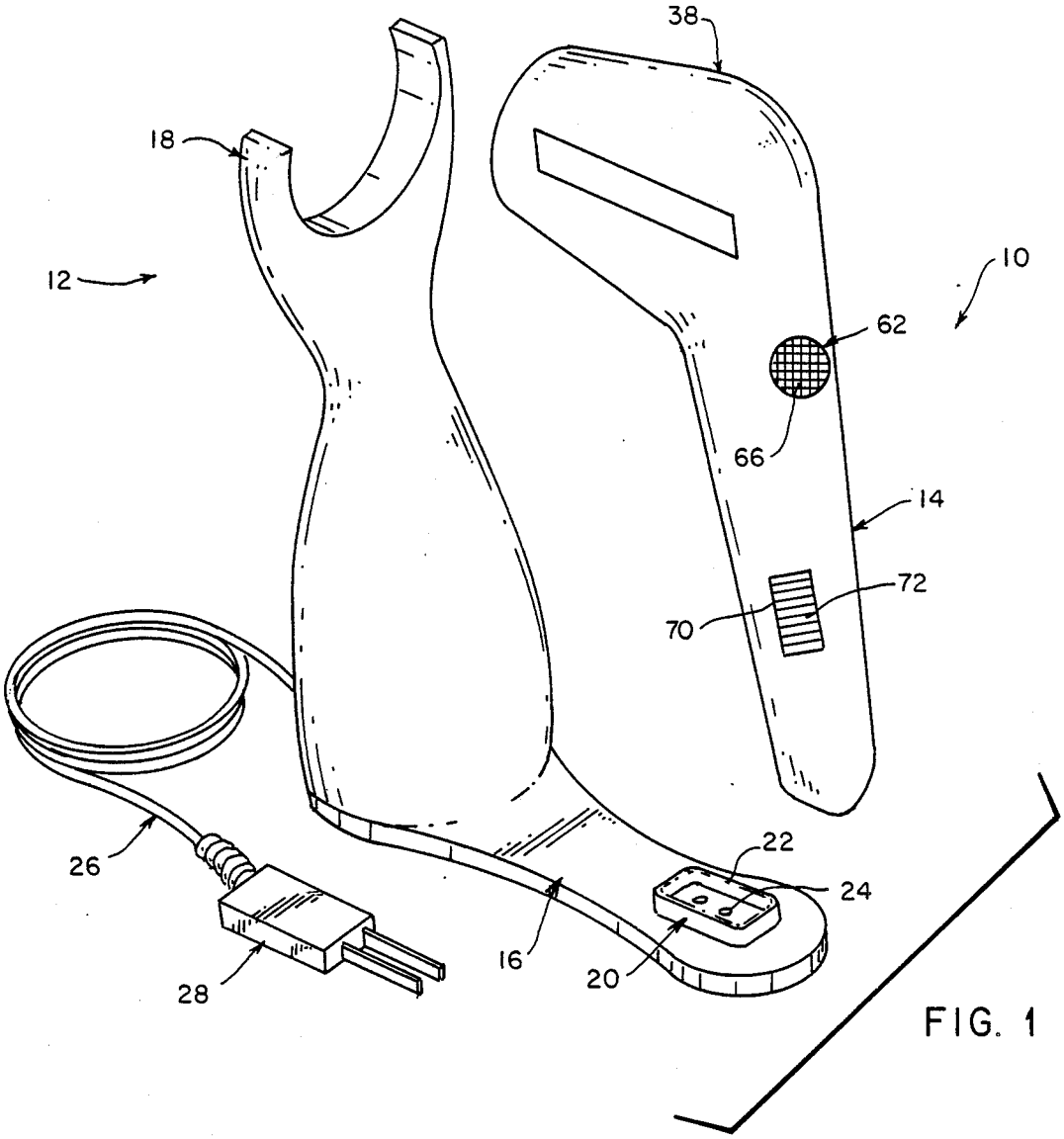
FIG. 1 is a perspective of the portable hair dryer assembly of the present invention.
Figure 2:
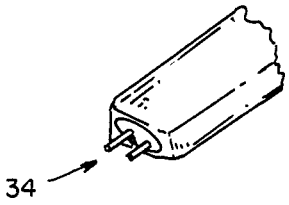
FIG. 2 is a bottom view of the handle unit of the portable hair dryer assembly of the present invention.

Shown in FIG. 1 is a portable hand-holdable hair dryer assembly 10 embodying the present invention. The assembly includes a stand unit 12 and a hand-holdable hair dryer unit 14.

The stand unit 12 includes a base 16 and a cradle 18 extending upwards therefrom. The base 16 includes an electrical connector element 20 having a plug-clasping shield 22 surrounding a pair of female plug receptacles 24 which are electrically connected to a power cord 26 having a plug 28 thereon. The plug 28 is used to connect the assembly to a source of utility power to place such power at the connector element 20 for a purpose to be discussed below.

The hair dryer unit 14 includes a handle 30 having a lower end 32 which includes a male plug connector element 34 for establishing electrical connection with the source of utility power via the connector 20. The hair dryer unit further includes a top portion 38 having a heel portion connecting that top portion to the handle.

Figure 3:
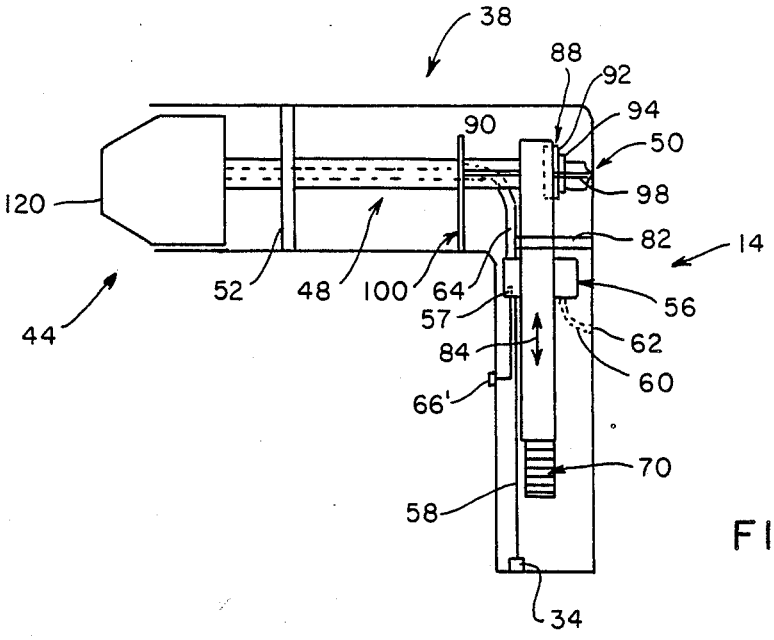
FIG. 3 is a cutaway elevational view showing the air moving system and the means for moving the exhaust nozzle unit of the portable hair dryer assembly of the present invention.

Referring to FIG. 3, it is seen that the hair dryer unit 14 includes an air-heating and moving system which includes an exhaust nozzle 44 mounted in the top portion 38 for multi-degree movement with respect to that top portion. The nozzle is mounted in the hair dryer unit by a mounting element such as a hollow rod 48 that extends longitudinally of the top portion from the nozzle and is movably mounted on the heel portion at a pivot 50 by means such as a step bearing, a thrust bearing, or the like. The pivot 50 is indicated in FIG. 3 as being a point mounting, but other mounts can be used, just so the rod and nozzle are securely mounted in the unit but can move in the manner described herein.

A flexible mounting element 52, such as a spider or the like, is securely mounted on the hair dryer top portion to support the nozzle supporting rod in a manner that permits the nozzle to be securely mounted yet permits the nozzle to move with respect to the top portion 38. The mounting element 52 can include a slot through which the element 48 is received with the slot being oriented to extend into and out of the plane of the paper on which FIG. 3 is illustrated so as to permit the element 48 to move in such direction.

The hair dryer assembly includes a motor unit 56 that is driven by a rechargeable battery 57 and a fan (not shown) connected to the motor to be driven thereby. The fan and the motor are not shown since they can be elements common to the hair dryer art, and the batteries are not specifically discussed as any rechargeable battery can be used. Suitable charging controls can be included in the recharging system so the entire assembly can be left connected to the source of utility power when not in use or between uses. Access to the motor unit for replacing the battery or the like can be gained via a hatch door D shown in FIG. 1.

The batteries are recharged using utility power via the connector 34 and leads, such as 58.

The air moving system further includes an air intake conduit 60 fluidically connecting an intake port 62 to the fan/motor unit, and a further conduit 64 fluidically connecting the fan/motor unit to the nozzle via the hollow rod 48. Air moves into the intake port 62, is heated and is moved out of the nozzle 44 by the air moving system of the apparatus 10.

Referring again to FIG. 1, it is seen that the apparatus 10 includes a fine mesh screen 66 covering the intake port. The screen is fine enough to prevent loose hair from entering the intake system, but is not so fine as to inhibit smooth operation of the apparatus even if some hair is located over the screen. A mesh size of about 10 on the Tyler standard screen scale is preferred.

An on/off switch 67 controls the operation of the hair dryer apparatus, and an air heating system is also included in the fan system, and is operated by a temperature control 67. The air heating system will not be discussed as those skilled in the art will know how to arrange such as system.

Figure 4:
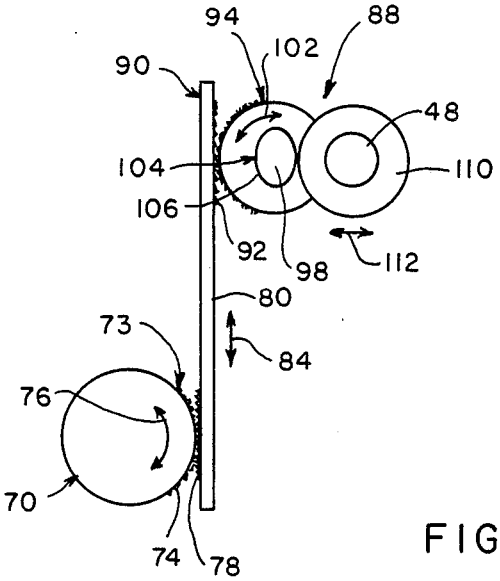
FIG. 4 is a schematic of the nozzle moving system used in the portable hair dryer assembly of the present invention.

Referring to FIGS. 3 and 4, the system for moving the nozzle 44 with respect to the top portion 38 is shown. The nozzle moving system includes a knob 70 rotatably mounted on the hair dryer handle in a location to be rotated back and forth by a user's thumb as that user grasps the handle. The knob has knurling 72 on one portion of the outer periphery in a location to contact the user's thumb, and a pinion portion 73 having teeth means 74 in another portion of the outer periphery. Movement of the knob by contacting the knurling will move the teeth 74 in the direction indicated by the double headed arrow 76.

The gear teeth 74 engage co-operating gear means 78 on one end of a rack 80 that is mounted by a brace 82 fixed to the hair dryer and which permits the rack to move up and down as indicated by the double-headed arrow 84 in response to the rotational movement of the knob 70. The rack 80 extends from subadjacent to the knob to a location spaced above the rod 48, and includes a second gear system 88 near an upper end 90 thereof.

The second gear system 88 meshes with gear teeth means 92 on a second pinion means, such as circular mounting member 94. The circular mounting member is rotatably mounted on the hair dryer assembly by a mounting pin 98 that is fixed at one end thereof to the heel section and at the other end thereof to a mounting element 100 fixed to the top portion. The circular mounting member rotates about the pin 98 in a direction indicated by the double-headed arrow 102 in response to the up and down movement of the rack 80.

A non-circular cam 104 is mounted on the circular mounting member to be rotated about the axis defined by the pin 98 as the circular mounting member rotates in the directions 102. The cam 104 has an ellipticly shaped outer periphery 106 that engages the outer periphery of a circular cam follower 110.

The cam follower 110 is mounted on the rod 48. As the rack moves up and doWn in response to rotation and counter rotation of the knob 70, the circular mounting member 94 is rotated and counter-rotated by the meshed engagement of the gear means 88 and 92 to rotate and counter rotate the elliptical cam 104. The cam engages the circular cam follower 110, and rotation and counter rotation of the cam 104 moves the cam follower back and forth in the direction of double-headed arrow 112.

Since the element 48 is mounted in the flexible and resilient mounting 52 and at location 50, the back and forth movement of the cam follower and the biasing force associated with the mounting 52 moves the nozzle-mounting element 48 back and forth in the direction of the double-headed arrow 112. The flexible mounting element 52 is designed to permit movement in one direction under the influence of the cam follower, and to bias the nozzle-mounting element 48 in the reverse direction to force that element back as the cam follower moves back into the FIG. 4 position. The mounting 52 can thus include rubber or other such flexible and/or resilient flaps or the like through which the element 48 passes. The flexibility of that part of the rubber mounting element 52 that contacts the element 48 is adjusted to permit such sideways movement under the influence of the cam follower, yet to move the element back to a central position after the moving force of the cam follower is removed. Springs or the like can also be included in the mounting element 52 if suitable. The springs will be connected at one end to the top portion 38 and at the other end thereof to the element 48 to be compressed when the element 48 is moved one way under the influence of the cam follower so that the spring will move the element 48 back when the moving force of the cam follower is removed. The pivot 50 can also be suitably designed to permit the desired amount of movement of the nozzle in response to movement of the knob 70. Suitable linkages, gimballings and mountings for the nozzle 44 can also be included to connect the nozzle to the element 48 or to mount the nozzle on the top portion 38 in a manner that a reciprocating motion is imparted to the nozzle exit plane 120 in response to the movement of the element 48.

As will be apparent from the foregoing, movement of the nozzle is effected by movement of the overall assembly as well as by rotation and counter rotation of the knob 70.

It is to be understood that while certain forms of the present invention have been illustrated and described herein, it is not to be limited to the specific forms or arrangement of parts described and shown.

We claim:

1. A portable hand-holdable hair dryer assembly comprising:

(A) a stand unit which includes (1) a base, (2) an upright cradle mounted on said base, (3) an electrical connector element located in said base, (4) means for connecting said electrical connector element to a source of electrical power; (B) a portable hair dryer unit which includes (1) a handle portion having an electrical connector therein for connection to said base electrical connector element, (2) a rechargeable battery system mounted in said handle and connected to said handle electrical connector to be charged by said source of electrical power, (3) a fan mounted in said handle portion, (4) a motor mounted in said handle portion and connected to said rechargeable battery system to be operated therefrom and to said fan to drive said fan, (5) a nozzle movably mounted in said hair dryer unit and receiving air therefrom and further including means for moving said nozzle, said nozzle moving means including (a) a knob rotatably mounted on said handle portion, (b) a pinion means on said knob and having teeth means, (c) a rack reciprocally movably mounted on said handle portion and having first gear means meshed with said knob pinion means teeth means and a second gear means, (d) a second pinion means rotatably mounted on said handle portion and including gear teeth means meshed with said rack second gear means to rotate said second pinion means as said rack means moves, (e) an eccentric cam mounted on said second pinion means to rotate therewith, (f) a cam follower abutting said cam to be moved as said cam rotates and connected to said nozzle to move said nozzle as said cam follower is moved by said eccentric cam; and (C) an air intake system which includes a fine mesh screen.

* * * * *